US005615557A

United States Patent [19]

Binneberg et al.

[11] Patent Number: 5,615,557

[45] Date of Patent: Apr. 1, 1997

[54] APPARATUS FOR SELF-SUFFICIENTLY COOLING HIGH TEMPERATURE SUPERCONDUCTING COMPONENTS

[75] Inventors: Armin Binneberg, Freital; Johannes Neubert; Gabriele Spoerl, both of Dresden; Walter Wolf, Juelich, all of Germany

[73] Assignees: Institut fuer Luft-und Kaeltetechnik Gemeinnuetzige Gesellschaft mbH, Dresden; Forschungszentrum Juelich GmbH, Juelich, both of Germany

[21] Appl. No.: 310,831

[22] Filed: Sep. 22, 1994

[30] Foreign Application Priority Data

Sep. 22, 1993 [DE] Germany ..... 43 32 156.9

[51] Int. Cl.[6] ..... F25B 19/00

[52] U.S. Cl. ..... 62/51.1; 62/54.2; 62/54.3; 62/430

[58] Field of Search ..... 62/51.1, 54.2, 62/54.3, 430

[56] References Cited

U.S. PATENT DOCUMENTS

| | | | |
|---|---|---|---|
| 1,680,873 | 8/1928 | Lucas-Girardville | 62/54.3 |
| 3,545,226 | 12/1970 | Newell | 62/54.3 X |
| 3,702,932 | 11/1972 | Tanner et al. | 62/51.1 X |
| 3,745,785 | 7/1973 | Crawford et al. | 62/388 |
| 4,658,601 | 4/1987 | Burchell et al. | 62/51.1 |
| 4,756,164 | 7/1988 | James et al. | 62/119 |
| 4,821,907 | 4/1989 | Castles et al. | 62/430 |
| 5,477,693 | 12/1995 | Morita | 62/51.1 X |

FOREIGN PATENT DOCUMENTS

| | | | |
|---|---|---|---|
| 3445674 | 6/1986 | Germany . | |
| 3639881 | 6/1988 | Germany . | |
| 4033383 | 4/1992 | Germany . | |
| 0242141 | 4/1969 | U.S.S.R. | 62/54.3 |
| 0386273 | 6/1973 | U.S.S.R. | 62/54.3 |

*Primary Examiner*—Christopher Kilner
*Attorney, Agent, or Firm*—W. G. Fasse; W. F. Fasse

[57] ABSTRACT

A cooling apparatus especially for cooling high-temperature-superconducting electronic components includes a cold gas cooling machine, such as a Stirling machine, thermally connected to a pressure vessel serving as a cold reservoir vessel. The pressure vessel contains a working medium having a triple point in the temperature range from about 60K to about 90K and a critical temperature at least as high as the maximum operating room temperature of the apparatus. The working medium is propane, for example. A cooling surface of the electronic component is thermally connected to the pressure vessel. In the method of operating the apparatus, the electronic component does not require continuous cooling. During a charging or refrigerating phase, the cooling machine freezes the working medium. Then during a useful cooling phase, the cooling machine is switched off and the electronic component is operated while being cooled by the frozen working medium.

20 Claims, 1 Drawing Sheet

APPARATUS FOR SELF-SUFFICIENTLY COOLING HIGH TEMPERATURE SUPERCONDUCTING COMPONENTS

FIELD OF THE INVENTION

The invention relates to a self-contained and self-sufficient apparatus for cooling high-temperature-superconducting, electronic components, and especially such an apparatus using a cold reservoir together with an intermittently operating cooling machine. The invention further relates to a method carried out with such an apparatus.

BACKGROUND INFORMATION

Methods and apparatus for cooling high-temperature-superconducting, microelectronic components must meet very high demands regarding the constancy of the cooling temperature as well as the avoidance of negative influences on the microelectronic components due to electromagnetic and mechanical oscillations or vibrations of the cooling apparatus. Especially because such microelectronic components have a very small tolerance for or resistance to vibrations, no practical cooling systems exist in which compressor equipment is used for providing the cooling.

Prior apparatus rely on complicated, costly and only partially successful mechanical measures for damping out or isolating from the electronic component the vibrations produced by a cooling machine, such as a Stirling machine. Such arrangements are disclosed in German Patent 3,445,674 and German Patent Laying-Open Document 3,639,881. According to these two German Patent Publications, an electronic component is thermally coupled to the cooling station of a cooling machine, such as a Stirling machine, by a flexible, thermally conducting metal band or strap. In this manner, heat can be removed from the electronic component while it is at least partially isolated from the mechanical vibrations of the cooling machine.

In order to completely avoid the mechanical vibrations of a cooling machine, it is also known to cool an electronic component using a cryogenic liquid that is delivered to the cooling location in a controlled manner from a storage container, such as a Dewar flask. German Patent Laying-Open Document 4,033,383 discloses such a cooling system for electronic components. In the disclosed system, a vaporization chamber is arranged in communication with the cryogenic liquid storage container. The electronic component is mounted on a thermally conducting cooling finger, which extends into the vaporization chamber. The heat conducted away from the component causes the cryogenic fluid in the vaporization chamber to evaporate, whereby the finger and the component can be cooled down to the vaporization temperature. The temperature can be controlled by controlling an electric heater near the cooling finger and also by adjusting a throttle valve through which the evaporated cooling medium returns from the vaporization chamber to the storage container. In the disclosed embodiments, nitrogen is used as the cryogenic fluid.

Even though no compressor or other cooling machine is involved in the above described cooling system, vibrations still arise and negatively influence the operation of the electronic component due to the boiling of the cryogenic liquid. Namely, as the cryogenic cooling medium evaporates, bubbles of the medium boil up in the vaporization chamber and cause vibrations of the cooling finger, which directly conducts the vibrations to the electronic component. Furthermore, the system is not a closed or sealed system, and it is necessary to refill additional cryogenic liquid into the storage container after a certain period of cooling operation.

Another known cooling system for electronic sensors includes a condenser for nitrogen arranged on the cold head or cold end of a Stirling machine. An evaporator is arranged to cool the sensor elements and is connected to the condenser by respective conduits for the liquid and gaseous nitrogen. The use of conduits, which have a capillary size, substantially decouples the vibrations of the Stirling machine from the evaporator and the sensor elements. However, for certain applications such an arrangement is too costly and complicated. Furthermore, such an arrangement cannot ensure a total isolation or freedom from vibration at the measuring point of the electronic sensors.

OBJECTS OF THE INVENTION

In view of the above, it is the aim of the invention to achieve the following objects singly or in combination:

to provide a simple, self-contained and self-sufficient cooling apparatus for electronic components, especially high-temperature-superconducting components such as sensors, wherein the pertinent sensing or measuring point is completely free of the vibrations of the cooling machine during operation of the sensor;

to provide such a cooling apparatus in which vibrations due to the boiling of a cryogenic liquid are also avoided;

to provide such a cooling apparatus that is a substantially sealed, closed system, which does not require the cooling medium to be replenished in order to repeat a cooling cycle;

to provide such an apparatus that achieves a substantially constant cooling temperature, independent of power fluctuations in the power supply or the like during a cooling phase of operation;

to provide such a cooling apparatus that achieves a substantially constant cooling temperature, substantially independent of the rate at which heat must be removed from the electronic component;

to provide such a cooling apparatus that operates with a non-continuous cooling cycle including a cooling phase and a refrigerating or cold-storing phase;

to provide such a cooling apparatus that uses a cooling medium that transitions from a solid to a liquid during the cooling operation to achieve cooling at a constant melting temperature with only a small dependence on pressure, whereby the apparatus can have a simplified construction; and to provide a method for cooling electronic components in a manner corresponding to the objects described above.

SUMMARY OF THE INVENTION

The above objects have been achieved in an apparatus for self-sufficiently cooling electronic components, preferably high-temperature-superconducting components such as sensors, including a cold gas cooling machine and a reservoir vessel connected to the cold head or cold end of the cooling machine. The reservoir vessel contains a working medium that has a triple point in the temperature range from about 60K to about 90K and has a critical temperature high enough that a liquid phase exists even at a maximum room temperature in which the apparatus is to operate. The maximum room temperature may be about 40° C. to 50° C. for example. A cooling surface of the electronic component is attached to the reservoir vessel, which is preferably a spherical pressure vessel. Furthermore, a pressure compensation vessel may be attached to the reservoir vessel.

Specific examples of the working fluid include propane, a mixture of methane with 50% propane, a mixture of methane with 30% ethane or any mixture having a eutectic melt characteristic. More generally, any working medium or working medium mixture can be used which has the following characteristics. To achieve cooling in the working temperature range of high-temperature-superconductor elements, the triple point temperature of the working medium must be in the range from about 60K to about 90K, as mentioned above. Furthermore, the critical temperature must be high enough so that the liquid phase still exists at the maximum operating room temperature of the apparatus, for example, a maximum room temperature of about 40° C. to 50° C. Finally, the largest possible thermal storage capacity is to be achieved in any given volume of the reservoir vessel. Therefore, the product of the working medium's melting enthalpy and density at the melting point must be as large as possible.

It should further be understood that nitrogen is not well suited for use as a working medium in the apparatus according to the invention, because the otherwise typical use of the vaporization heat of nitrogen through a condensation and evaporation cycle would require a relatively large, external, constant-pressure buffer vessel connected to the necessarily closed system.

The above objects are achieved according to the method of the invention in which the cooling machine first refrigerates the working medium in the reservoir vessel at least down to its liquid-solid transition temperature. After the working medium has been at least partially solidified, and preferably completely solidified, the cooling machine is switched off. Then the working medium is allowed to melt at a constant melting temperature. The actual cooling phase of the cycle, i.e. cooling of the electronic components, is carried out during the melting of the working medium.

As a starting point, the idea of the invention presumes that in many applications it is sufficient to provide a non-continuous or time-limited cooling for the electronic components. Thus, the apparatus and method according to the invention are characterized by the use of a latent reservoir for cryogenic temperatures, with an alternating operating cycle including a refrigerating phase in which the cooling machine operates to freeze the working medium and thereby store so-called cold energy as a latent transition energy, and the actual useful cooling phase in which the cooling machine is switched off and the frozen working medium melts.

The components of the apparatus are dimensioned in such a manner that the cooling capacity of the cooling machine is substantially greater than the required cooling load, so that the useful cooling phase of the operating cycle has a long duration relative to the cold-storing or refrigerating phase. Furthermore, because the invention makes use of the solid-liquid transition point, whereby the melting temperature is only very slightly dependent on the pressure, the apparatus can have a relatively simple construction.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
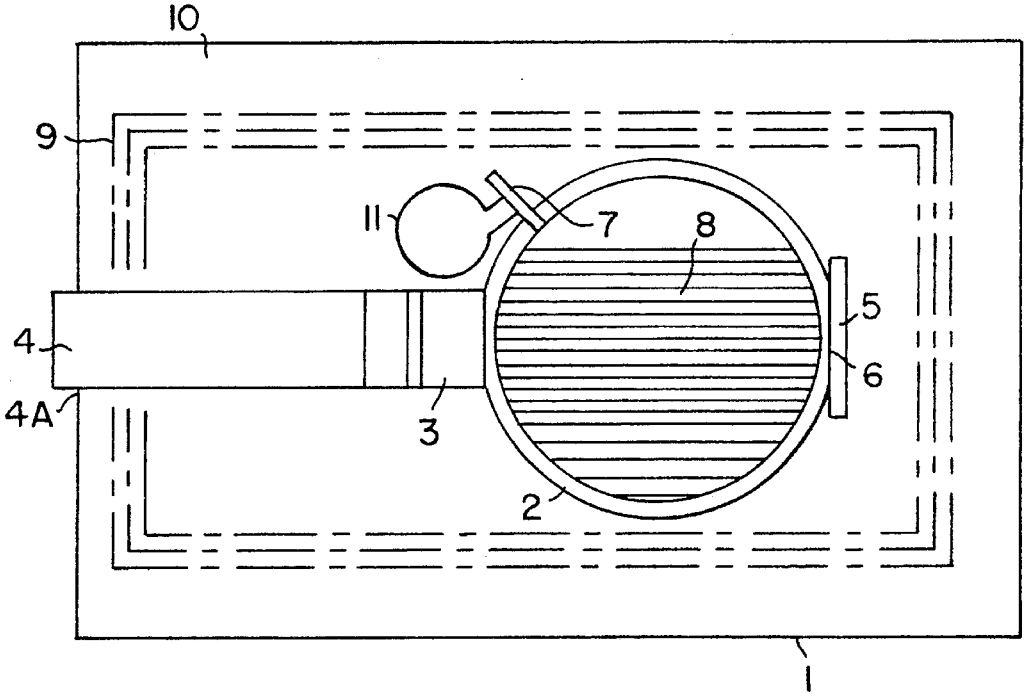
FIG. 1 is a schematic view of the cooling apparatus according to the invention.

As shown schematically in FIG. 1, the cooling apparatus of the invention includes a reservoir vessel, which is preferably a spherical pressure vessel 2, arranged within a housing 1. In this example embodiment, the pressure vessel 2 is made of copper and has a diameter of 50 mm and a wall thickness of 0.4 mm. The cold end or cold head 4 of a split Stirling machine extends into the space within the housing 1. A thermally conducting adapter 3 connects the pressure vessel 2 with the cold head 4 of the split Stirling machine, so that heat can be conducted from the pressure vessel 2 to the cold head 4.

An electronic component, such as a high-temperature-superconducting sensor, that is to be cooled has a sensor cooling surface 5, which is thermally connected to a contact surface 6 provided on the pressure vessel 2. The cooling surface 5 may be mounted directly on the contact surface 6, for example by brazing, bolting or thermally conductive adhesive. An optical window or electrical conductors can be provided for the sensor in a manner that is generally known in the art and not shown in FIG. 1.

A filling nipple 7 is provided on the pressure vessel 2. After evacuating the pressure vessel 2, an appropriate, measured amount of the working medium 8, such as propane, is filled and condensed into the pressure vessel 2 through the filling nipple 7. Thereafter, the nipple 7 is hermetically sealed. The appropriate quantity of working medium 8 to be used in different situations can be determined by experiment or by calculation, i.e. to provide the optimum or desired cooling capacity for the desired length of time.

The space within the housing 1 is evacuated to provide an insulation or isolation vacuum 10, within which the cold head 4 of the split Stirling machine, the pressure vessel 2 and the sensor cooling surface 5 are arranged in a thermally isolated manner. A seal 4A is provided to seal the housing 1 with respect to the cold head 4 of the split Stirling machine. Furthermore, radiation protective shielding 9 may be arranged within the housing 1 to further insulate the working components of the apparatus. In order to help maintain a constant pressure in the pressure vessel 2 throughout the operating cycle, a pressure compensation vessel 11 optionally may be connected to the pressure vessel 2, for example, at the filling nipple 7. Temperature sensors and related controls for the Stirling machine are arranged in a conventionally known manner.

The method of the invention, which is carried out in the apparatus described above, will now be described with reference to FIG. 2. After the desired quantity of propane 8 has been filled into the pressure vessel 2 and the pressure vessel 2 has been sealed as described above, the split Stirling machine is switched on at point A in FIG. 2. Note that point A is assigned the time coordinate of 2 hours somewhat arbitrarily, allowing for filling and any pre-cooling of the propane. The Stirling machine steadily cools the propane from a temperature of about 210K as shown at point A, to about 77.5K at point B, which occurs at about 4½ hours, i.e. 2½ hours after switching on the Stirling machine. At point B, the propane has been undercooled to a temperature about 8K below its liquid-solid transition temperature of 85.5K.

Upon reaching point B, crystallization and solidification of the propane has begun, and the temperature rises slightly to the liquid-solid transition temperature of 85.5K. The Stirling machine continues to operate and the propane continues to crystallize and solidify at a substantially constant temperature until the propane has completely transitioned to the solid phase at point C. The Stirling machine preferably continues to operate somewhat after point C, and undercools the solid propane, for example to a temperature about 10K below the liquid-solid transition temperature, at point D. Upon reaching point D, the Stirling machine has been switched off.

After the Stirling machine has been switched off, at point D, the latent energy reservoir formed by the pressure vessel containing the frozen propane warms up slightly to the melting temperature of the propane at point E. Between points E and F, i.e. from operating hours 6 to 10½, the propane melts at a substantially constant temperature. During this phase from point E to point F, the high-temperature-superconducting electronic component is operated and cooled by the cooling apparatus of the invention. Thus, the period between points E and F represents the actual useful cooling phase, during which no vibrations or other interference are caused by the Stirling machine, which has been switched off. Furthermore, because the solid-liquid phase transition of the working medium is utilized for cooling, a very constant cooling temperature is established, and substantially no vibrations are caused by boiling of the working medium.

At point F, the propane has completely melted, whereupon the pressure vessel begins to warm up to point G, due to the heat received from the electronic component and from any external heat that might leak into the insulated vacuum housing. Thus, preferably before reaching point F, the electronic component has been switched off, or it has been allowed to idle or been taken out of operating service. At point G, the Stirling machine is again switched on to cool the propane working medium to its freezing temperature at point H. When the propane is again completely frozen, the Stirling machine is again switched off and the cooling phase of the cycle is repeated, during which the sensor is operated to make its critical measurements.

Figure 2:
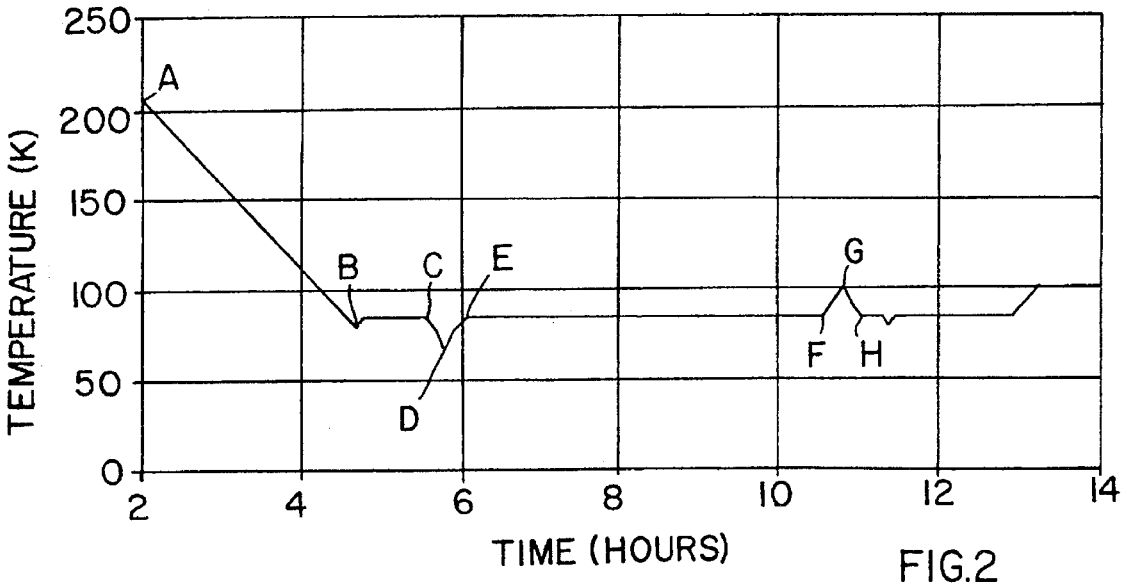
FIG. 2 is a graph of the temperature measured in the reservoir vessel of the apparatus as a function of time during an operating cycle according to the method of the invention.

The operating cycle shown in FIG. 2 is merely one example of such a cycle. It should be noted, that the initial refrigerating phase from point A to point B need not be carried out for each repeated operating cycle. Rather, because the propane begins the next refrigerating phase at 100K, for example, a much shorter refrigeration period is necessary, as shown between points G and H in FIG. 2.

The ratio of the running time or duty cycle of the Stirling machine relative to the vibration-free usable cooling time is dependent on the ratio of the Stirling machine output capacity relative to the cooling losses and cooling requirements. For example, a Stirling machine output capacity is typically 1 W and the cooling losses plus the usable cooling load are typically 0.2 W. For these typical specifications, the maximum cold storage or reserve capacity is about 1.28 Wh. Thus, for a refrigerating or charging time of approximately 10 minutes, the cold reservoir can provide useful cooling for about 50 minutes. Similarly, after a maximum refrigerating or charging time of about 1 hour, the cold reservoir can provide about 5 hours of useful cooling capacity. It should be understood that it is not necessary to completely freeze the propane during the refrigerating or charging phase, before starting the vibration-free useful cooling phase. It is, of course, also necessary to take into account the amount and type of working medium that is contained in the pressure vessel.

Although the invention has been described with reference to specific example embodiments, it will be appreciated that it is intended to cover all modifications and equivalents within the scope of the appended claims.

What is claimed is:

1. An apparatus for cooling an electronic component, said apparatus comprising a cold gas cooling machine having a cold head, a reservoir vessel that is permanently and continuously connected in a thermally conducting manner to said cold head and is connected in a thermally conducting manner to said electronic component, and a working medium contained in said reservoir vessel, wherein said working medium has a triple point within the temperature range from about 60K to about 90K and a critical temperature above a maximum operating room temperature of said apparatus.

2. The cooling apparatus of claim 1, wherein said electronic component has a cooling surface and said reservoir vessel has a contact surface, and wherein said cooling surface of said electronic component is attached directly onto said contact surface of said reservoir vessel.

3. The cooling apparatus of claim 1, wherein said maximum operating room temperature is in the range from about 40° C. to about 50° C., at which the liquid phase of said working medium still exists.

4. The cooling apparatus of claim 1, wherein said cooling machine comprises a split Stirling machine.

5. The cooling apparatus of claim 1, wherein said reservoir vessel is a hermetically sealed, spherical pressure vessel.

6. The cooling apparatus of claim 1, further comprising a pressure compensation vessel connected to said reservoir vessel.

7. The cooling apparatus of claim 1, further comprising a housing enclosing said cold head of said cooling machine and said reservoir vessel, with said cold head penetrating through and sealed relative to a hole in said housing, wherein a space within said housing is under a vacuum that impinges directly on said cold head.

8. The cooling apparatus of claim 7, further comprising radiation protective shielding arranged within said housing around said reservoir vessel.

9. The cooling apparatus of claim 1, wherein said working medium is propane.

10. The cooling apparatus of claim 1, wherein said working medium is a mixture comprising methane and 50% propane.

11. The cooling apparatus of claim 1, wherein said working medium is a mixture comprising methane and 30% ethane.

12. The cooling apparatus of claim 1, wherein said working medium is a mixture having a eutectic melting characteristic.

13. A method of cooling an electronic component using an apparatus including a cooling machine and a reservoir vessel that are permanently and continuously connected together in a thermally conducting manner, wherein the reservoir vessel contains a working medium that has a triple point within the temperature range from about 60K to about 90K and a critical temperature above a maximum operating room temperature of the apparatus, said method comprising:

(a) operating the cooling machine to at least partially freeze the working medium contained in the reservoir vessel;

(b) stopping the cooling machine while maintaining the cooling machine permanently and continuously connected to the reservoir vessel in a thermally conducting manner; and (c) after stopping the cooling machine and while still maintaining the cooling machine permanently and continuously connected to the reservoir vessel in a thermally conducting manner, operating the electronic component and conveying heat from the electronic component to the working medium, to cool the electronic component while the frozen working medium melts.

14. The cooling method of claim 13, wherein said step (a) of operating the cooling machine is continued until the working medium is completely frozen.

15. The cooling method of claim 14, wherein said step (a) of operating the cooling machine is continued even after the working medium is completely frozen.

16. The cooling method of claim 13, further comprising a step (d) of taking the electronic component out of service and then repeating said steps (a) to (c).

17. The cooling method of claim 16, wherein said taking the electronic component out of service is performed before the frozen working medium is completely melted.

18. The cooling method of claim 13, wherein a duration of carrying out said step of conveying heat from the electronic component to the working medium is longer than a duration of carrying out said step (a) of operating the cooling machine.

19. The cooling apparatus of claim 1, wherein said reservoir vessel is permanently hermetically sealed.

20. The cooling apparatus of claim 1, wherein said cold head is rigidly connected to said reservoir vessel.

* * * * *